US008960584B1

(12) United States Patent
Fearon

(10) Patent No.: US 8,960,584 B1
(45) Date of Patent: Feb. 24, 2015

(54) CORD STORAGE DEVICE

(76) Inventor: Colin Fearon, Woodside, NY (US)

( * ) Notice: Subject to any disclaimer, the term of this patent is extended or adjusted under 35 U.S.C. 154(b) by 212 days.

(21) Appl. No.: 13/445,906

(22) Filed: Apr. 12, 2012

(51) Int. Cl.
*B65H 75/38* (2006.01)

(52) U.S. Cl.
USPC ..... 242/405; 242/400.1; 242/405.1; 242/405.2; 242/405.3

(58) Field of Classification Search
CPC ..... B65H 75/28; B65H 75/406; B65H 2402/412; B65H 2701/34
USPC ..... 242/400.1, 405, 405.1–405.3, 588, 242/588.2
See application file for complete search history.

(56) References Cited

U.S. PATENT DOCUMENTS 4,123,012 A 10/1978 Hough
D257,613 S 12/1980 Gruenewald
4,778,125 A 10/1988 Hu
5,348,240 A 9/1994 Carmo et al.
5,458,241 A 10/1995 Brown
6,024,317 A * 2/2000 Kovacik et al. ..... 242/405.1
6,142,405 A 11/2000 Black
6,237,885 B1 5/2001 Mitchell
6,484,787 B1 * 11/2002 Walters ..... 160/178.1 R
6,497,382 B2 * 12/2002 King ..... 242/405.2

* cited by examiner

*Primary Examiner* — Sang Kim

(57) ABSTRACT

A cord storage device is provided for storing an electrical cord without tangling. The device includes a planar member having a first end cutout forming a pair of spaced first end arms extending from a first end of a medial section of the planar member. The planar member further has a second end cutout forming a pair of spaced second end arms extending from a second end of the medial section of the planar member. A plurality of clips is coupled to the planar member. Each clip is configured for engaging a cord whereby the cord is securable to the planar member by engaging a first end of the cord to one of the clips, wrapping the cord around the planar member between the spaced first end arms and the spaced second end arms, and engaging a second end of the cord to another one of the clips.

20 Claims, 2 Drawing Sheets

CORD STORAGE DEVICE

BACKGROUND OF THE DISCLOSURE

Field of the Disclosure

The disclosure relates to cord storage devices and more particularly pertains to a new cord storage device for neatly and efficiently storing an electrical cord without tangling.

SUMMARY OF THE DISCLOSURE

An embodiment of the disclosure meets the needs presented above by generally comprising a planar member having a first end cutout forming a pair of spaced first end arms extending from a first end of a medial section of the planar member. The planar member further has a second end cutout forming a pair of spaced second end arms extending from a second end of the medial section of the planar member. A plurality of clips is coupled to the planar member. Each clip is configured for engaging a cord whereby the cord is securable to the planar member by engaging a first end of the cord to one of the clips, wrapping the cord around the planar member between the spaced first end arms and the spaced second end arms, and engaging a second end of the cord to another one of the clips.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
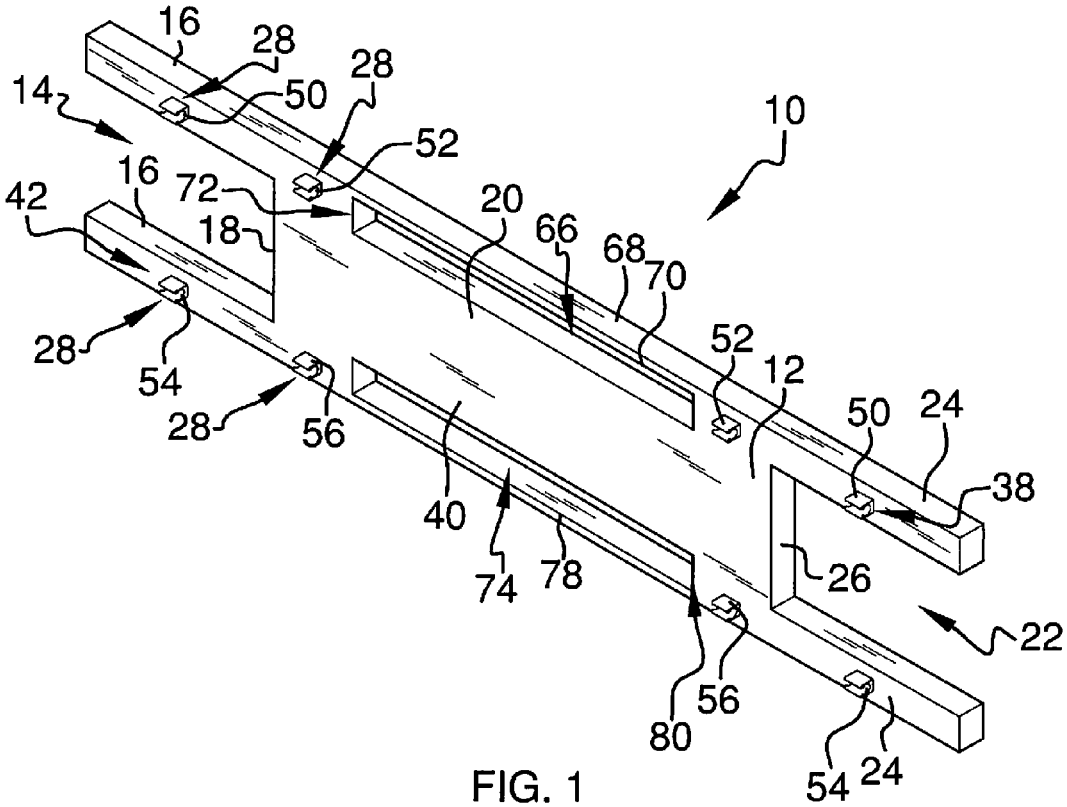
FIG. 1 is a top front side perspective view of a cord storage device according to an embodiment of the disclosure.
Figure 2:
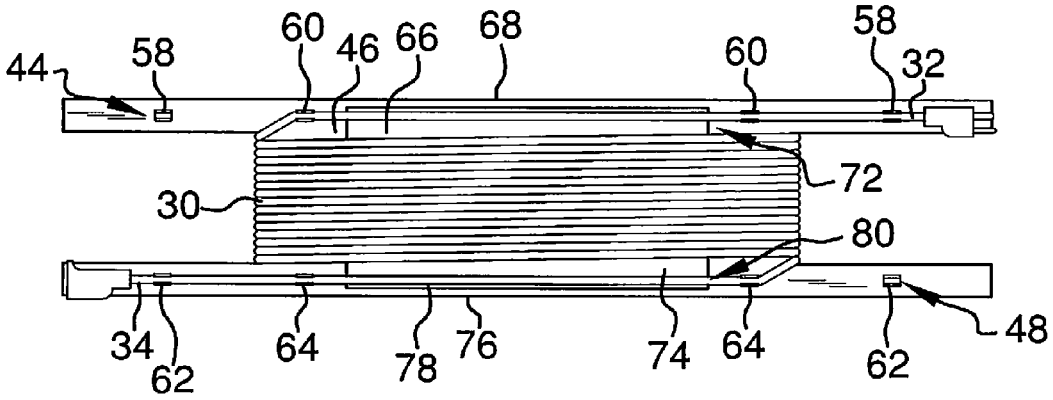
FIG. 2 is a back view of an embodiment of the disclosure.
Figure 3:
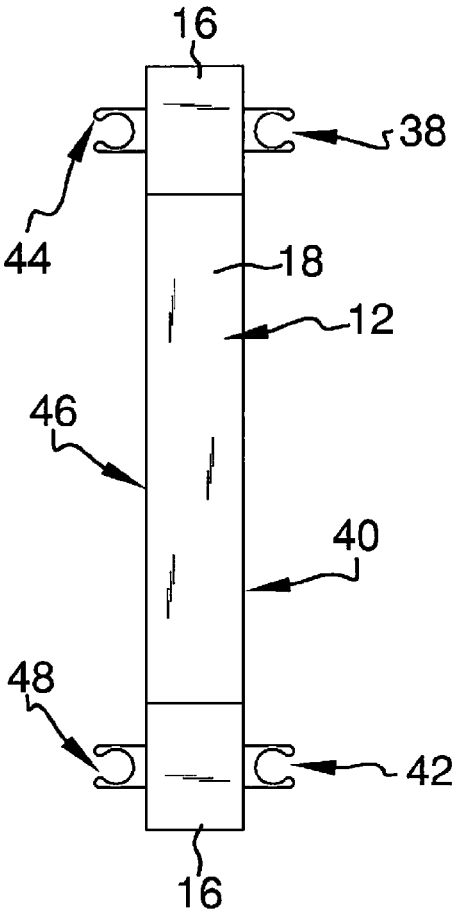
FIG. 3 is a side view of an embodiment of the disclosure.
Figure 4:
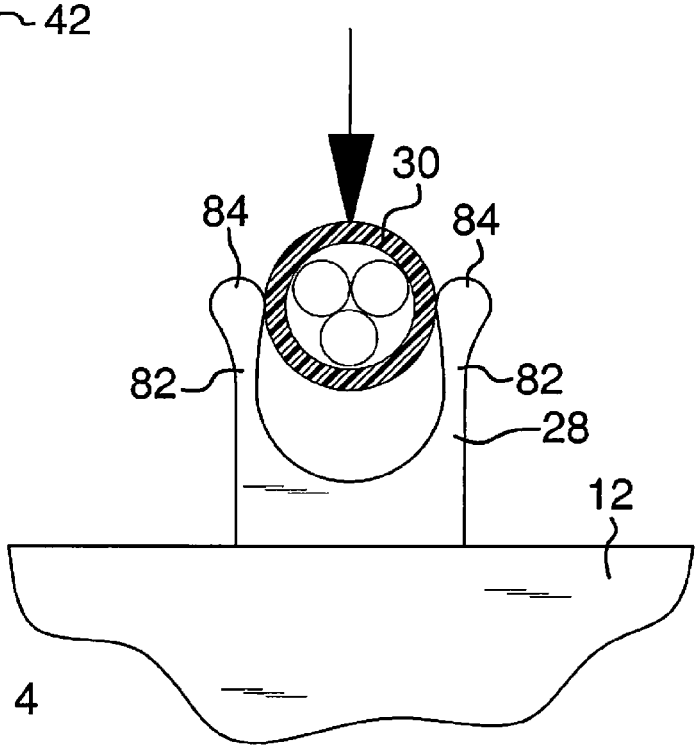
FIG. 4 is a detailed view of an embodiment of the disclosure.

With reference now to the drawings, and in particular to FIGS. 1 through 4 thereof, a new cord storage device embodying the principles and concepts of an embodiment of the disclosure and generally designated by the reference numeral 10 will be described.

As best illustrated in FIGS. 1 through 4, the cord storage device 10 generally comprises a planar member 12 having a first end cutout 14 forming a pair of spaced first end arms 16 extending from a first end 18 of a medial section 20 of the planar member 12. The planar member 12 similarly has a second end cutout 22 forming a pair of spaced second end arms 24 extending from a second end 26 of the medial section

20 of the planar member 12. A plurality of clips 28 is coupled to the planar member 12. Each clip 28 is configured for engaging a cord 30. Each clip 28 includes a pair of resilient spaced prongs 82 having bulbous ends 84. The ends 84 of the prongs 82 are shown being urged slightly outwardly in FIG. 4 as the cord 30 is passed between the prongs 82. Thus, the prongs 82 are shaped to wrap around the cord 30 to facilitate retention of the cord 30 between the prongs 82. The ends 84 of the prongs 82 are also rounded to facilitate insertion of the cord 30 between the prongs 82. Thus, the cord 30 may be secured to the planar member 12 by engaging a first end 32 of the cord 30 to one of the clips 28, wrapping the cord 30 around the medial section 20 of the planar member 12 between the spaced first end arms 16 and the spaced second end arms 24, and engaging a second end 34 of the cord 30 to another one of the clips 28.

The plurality of clips 28 includes an aligned upper row of front clips 38 coupled to a front side 40 of the planar member 12. The plurality of clips 28 includes an aligned bottom row of front clips 42 coupled to the front side 40 of the planar member 12. The plurality of clips 28 may include an aligned upper row of back clips 44 coupled to a back side 46 of the planar member 12 and an aligned bottom row of back clips 48 coupled to the back side 46 of the planar member 12.

Each of an outermost pair 50 of the upper row of front clips 38 is positioned on an associated one of the first end arms 16 and the second end arms 24. A medial pair 52 of the upper row of front clips 38 is positioned on the medial section 20 of the planar member 12. Each of an outermost pair 54 of the bottom row of front clips 42 is positioned on an associated one of the first end arms 16 and the second end arms 24. A medial pair 56 of the bottom row of front clips 42 is positioned on the medial section 20 of the planar member 12. Thus, each clip 28 on the front side 40 of the planar member is vertically and horizontally aligned with at least one other clip 28 on the front side 40 of the planar member 12.

Similarly, each of an outermost pair 58 of the upper row of back clips 44 is positioned on an associated one of the first end arms 16 and the second end arms 24. A medial pair 60 of the upper row of back clips 44 is positioned on the medial section 20 of the planar member 12. Each of an outermost pair 62 of the bottom row of back clips 48 is positioned on an associated one of the first end arms 16 and the second end arms 24. A medial pair 64 of the bottom row of back clips 48 is positioned on the medial section 20 of the planar member 12. Thus, each clip 28 on the back side 46 of the planar member is vertically and horizontally aligned with at least one other clip 28 on the back side 46 of the planar member 12. Additionally, each clip 28 on the front side 40 is aligned through the planar member 12 with an associated clip 28 coupled to the back side 46 of the planar member 12.

An elongated upper aperture 66 extends through the planar member 12 proximate an upper edge 68 of the planar member 12 forming an upper handle 70 in the planar member 12. The upper aperture 66 may be positioned entirely within the medial section 20 of the planar member 12. An upper portion 72 of the upper aperture 66 may be aligned with the upper row of front clips 38 and the upper row of back clips 44.

An elongated bottom aperture 74 extends through the planar member 12 proximate a bottom edge 76 of the planar member 12 forming a bottom handle 78 in the planar member 12. The bottom aperture 74 may also be positioned entirely within the medial section 20 of the planar member 12. A bottom portion 80 of the bottom aperture 74 may be aligned with the bottom row of front clips 42 and the bottom row of back clips 48.

In use, the first end 32 of the cord 30 to one or more of the clips 28. The cord 30 is wrapped around the medial section 20 such that the first end arms 16 and the second end arms 24 prevent the cord 30 from sliding laterally off of the planar member 12. The second end of the cord 34 is secured to at least one of the clips 28 to prevent the cord 30 from being unwrapped from the planar member 12 unintentionally. The planar member 12 and cord 30 may then be carried by grasping one or both of the upper handle 70 and the bottom handle 78.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A cord storage device comprising:

a planar member, said planar member having a first end cutout forming a pair of spaced first end arms extending from a first end of a medial section of said planar member, said planar member having a second end cutout forming a pair of spaced second end arms extending from a second end of said medial section of said planar member; and a plurality of clips coupled to said planar member, each clip extending outwardly transversely from said planar member wherein each said clip is configured for engaging a cord whereby the cord is securable to said planar member by engaging a first end of the cord to one of said clips along a face of said planar member, wrapping the cord around the planar member between said spaced first end arms and said spaced second end arms, and engaging a second end of the cord to another one of said clips, each said clip including a pair of resiliently spaced prongs having bulbous ends, said prongs having a shape complementary to a cross-sectional shape of the cord wherein said prongs abut and engage a single extent of the cord therebetween whereby the cord is coupled to the planar member.

2. The device of claim 1, further including said plurality of clips including an aligned upper row of front clips coupled to a front side of said planar member.

3. The device of claim 2, further including each of an outermost pair of said upper row of front clips being positioned on an associated one of said first end arms and said second end arms.

4. The device of claim 3, further including a medial pair of said upper row of front clips being positioned on said medial section of said planar member.

5. The device of claim 1, further including said plurality of clips including an aligned bottom row of front clips coupled to a front side of said planar member.

6. The device of claim 5, further including each of an outermost pair of said bottom row of front clips being positioned on an associated one of said first end arms and said second end arms.

7. The device of claim 6, further including a medial pair of said bottom row of front clips being positioned on said medial section of said planar member.

8. The device of claim 1, further including said plurality of clips including an aligned upper row of back clips coupled to a back side of said planar member.

9. The device of claim 8, further including each of an outermost pair of said upper row of back clips being positioned on an associated one of said first end arms and said second end arms.

10. The device of claim 9, further including a medial pair of said upper row of back clips being positioned on said medial section of said planar member.

11. The device of claim 1, further including said plurality of clips including an aligned bottom row of back clips coupled to a back side of said planar member.

12. The device of claim 11, further including each of an outermost pair of said bottom row of back clips being positioned on an associated one of said first end arms and said second end arms.

13. The device of claim 12, further including a medial pair of said bottom row of back clips being positioned on said medial section of said planar member.

14. The device of claim 1, further including an elongated upper aperture extending through said planar member proximate an upper edge of said planar member forming an upper handle in said planar member.

15. The device of claim 14, further including said upper aperture being positioned in said medial section of said planar member.

16. The device of claim 15, further comprising:

said plurality of clips including an aligned upper row of front clips coupled to a front side of said planar member;

said plurality of clips including an aligned upper row of back clips coupled to a back side of said planar member; and an upper portion of said upper aperture being aligned with said upper row of front clips and said upper row of back clips.

17. The device of claim 1, further including an elongated bottom aperture extending through said planar member proximate a bottom edge of said planar member forming a bottom handle in said planar member.

18. The device of claim 17, further including said bottom aperture being positioned in said medial section of said planar member.

19. The device of claim 18, further comprising:

said plurality of clips including an aligned bottom row of front clips coupled to a front side of said planar member;

said plurality of clips including an aligned bottom row of back clips coupled to a back side of said planar member; and a bottom portion of said bottom aperture being aligned with said bottom row of front clips and said bottom row of back clips.

20. A cord storage device comprising:

a planar member, said planar member having a first end cutout forming a pair of spaced first end arms extending from a first end of a medial section of said planar member, said planar member having a second end cutout forming a pair of spaced second end arms extending from a second end of said medial section of said planar member;

a plurality of clips coupled to said planar member, each clip being configured for engaging a cord whereby the cord is securable to said planar member by engaging a first end of the cord to one of said clips, wrapping the cord around the planar member between said spaced first end arms and said spaced second end arms, and engaging a second end of the cord to another one of said clips, said prongs having a shape complementary to a cross-sectional shape of the cord wherein said prongs abut and engage a single extent of the cord therebetween whereby the cord is coupled to the planar member, said plurality of clips including an aligned upper row of front clips coupled to a front side of said planar member, said plurality of clips including an aligned bottom row of front clips coupled to said front side of said planar member, said plurality of clips including an aligned upper row of back clips coupled to a back side of said planar member, said plurality of clips including an aligned bottom row of back clips coupled to said back side of said planar member, each said clip including a pair of resiliently spaced prongs having bulbous ends, said ends of said prongs being urged outwardly when the cord is passed between said prongs to facilitate retention of the cord between said prongs, said ends of said prongs being rounded to facilitate insertion of the cord between said prongs;

each of an outermost pair of said upper row of front clips being positioned on an associated one of said first end arms and said second end arms;

a medial pair of said upper row of front clips being positioned on said medial section of said planar member;

each of an outermost pair of said bottom row of front clips being positioned on an associated one of said first end arms and said second end arms;

a medial pair of said bottom row of front clips being positioned on said medial section of said planar member;

each of an outermost pair of said upper row of back clips being positioned on an associated one of said first end arms and said second end arms;

a medial pair of said upper row of back clips being positioned on said medial section of said planar member;

each of an outermost pair of said bottom row of back clips being positioned on an associated one of said first end arms and said second end arms;

a medial pair of said bottom row of back clips being positioned on said medial section of said planar member;

an elongated upper aperture extending through said planar member proximate an upper edge of said planar member forming an upper handle in said planar member, said upper aperture being positioned in said medial section of said planar member, an upper portion of said upper aperture being aligned with said upper row of front clips and said upper row of back clips; and an elongated bottom aperture extending through said planar member proximate a bottom edge of said planar member forming a bottom handle in said planar member, said bottom aperture being positioned in said medial section of said planar member, a bottom portion of said bottom aperture being aligned with said bottom row of front clips and said bottom row of back clips.

* * * * *